US008475164B2

(12) United States Patent
Ryser

(10) Patent No.: US 8,475,164 B2
(45) Date of Patent: Jul. 2, 2013

(54) APPARATUS AND METHOD FOR ROTATING A FIRE, A FLAME, A SMOKE PLUME, OR FOR CIRCULATING HEAT

(76) Inventor: Andreas Ryser, Arbon (CH)

( * ) Notice: Subject to any disclaimer, the term of this patent is extended or adjusted under 35 U.S.C. 154(b) by 664 days.

(21) Appl. No.: 12/572,370

(22) Filed: Oct. 2, 2009

(65) Prior Publication Data

US 2010/0104993 A1 Apr. 29, 2010

Related U.S. Application Data

(60) Provisional application No. 61/104,276, filed on Oct. 10, 2008.

(30) Foreign Application Priority Data

Oct. 2, 2008 (CH) ..... 1564/08

(51) Int. Cl.
*F23C 99/00* (2006.01)

(52) U.S. Cl.
USPC ..... 431/252; 431/8; 431/9; 431/289; 431/291

(58) Field of Classification Search
USPC ..... 431/252, 8, 9, 289, 291, 297; 126/519, 126/521, 524
See application file for complete search history.

(56) References Cited

U.S. PATENT DOCUMENTS

| | | | | |
|---|---|---|---|---|
| 3,499,432 | A * | 3/1970 | Hannebaum | 126/519 |
| 4,076,490 | A * | 2/1978 | Hilker | 431/125 |
| 5,055,031 | A | 10/1991 | Werner | |
| 7,090,369 | B1 | 8/2006 | Jordan | |
| 2002/0048739 | A1 | 4/2002 | Chu | |
| 2004/0175287 | A1 | 9/2004 | Nakatsu et al. | |
| 2004/0261780 | A1 | 12/2004 | Frink et al. | |
| 2006/0275721 | A1 | 12/2006 | Starr et al. | |

FOREIGN PATENT DOCUMENTS

| | | |
|---|---|---|
| DE | 20 2007 018 478 | 10/2008 |
| EP | 2 098 781 | 9/2009 |
| GB | 831712 | 3/1960 |
| WO | WO 2008/112379 | 9/2008 |

OTHER PUBLICATIONS

Screen prints of websites.
RietBrock et al., Wirbel-Strömungs-Kraftwerk, Kölner Innovationspreis 2002.

* cited by examiner

*Primary Examiner* — Alfred Basichas
(74) *Attorney, Agent, or Firm* — Da Vinci Partners LLC

(57) ABSTRACT

The invention relates to a device (10) and a method for rotating a flame and/or a plume of smoke, arranged with a heat source (36) in a chamber (16) with at least one gas inlet opening (24, 26, 30) and a gas outlet opening (32). The gas inlet opening (24, 26, 30) and the heat source (36) are located in a lower area (12, 20') of the chamber (16). The gas outlet opening (32) is located in an upper region (14) of the chamber (1.6). In this way, an ascending gas flow may be generated in the chamber (16). At least one gas inlet channel or nozzle (24, 26, 30, 40) is adapted to direct inflowing gas therethrough into the lower area (12, 20') of the chamber (16) approximately along an inner wall of the chamber about an at least approximately circular path following along the inner wall in the same rotational sense around the heat source and then is drawn upwardly by a draw of the upwardly flowing heated gases though the gas outlet opening (32). A flame or smoke plume inside the chamber (16) can thereby be placed into a rotary motion.

21 Claims, 9 Drawing Sheets

APPARATUS AND METHOD FOR ROTATING A FIRE, A FLAME, A SMOKE PLUME, OR FOR CIRCULATING HEAT

CROSS REFERENCE TO RELATED APPLICATIONS

This application claims the benefit of Swiss Patent Application No. CH 1564/08 filed Oct. 2, 2008, and U.S. Provisional Application No. 61/104,276, filed Oct. 10, 2008, the contents of which are incorporated by reference herein.

COPYRIGHT & LEGAL NOTICE

A portion of the disclosure of this patent document contains material which is subject to copyright protection. The copyright owner has no objection to the facsimile reproduction by anyone of the patent document or the patent disclosure as it appears in the Patent and trademark Office patent file or records, but otherwise reserves all copyright rights whatsoever. Further, no references to third party patents or articles made herein is to be construed as an admission that the present invention is not entitled to antedate such material by virtue of prior invention.

BACKGROUND OF THE INVENTION

The invention relates to a device for rotating a fire, flame, a plume of smoke or for circulating heat.

Light, especially candlelight, and/or smoke-producing devices are known. With such known devices, a heat source and a means for generating a flame and/or a plume of smoke, is arranged in a chamber having a gas inlet and a gas outlet. The gas inlet opening and the heat source are arranged at a bottom of the chamber and the gas outlet opening is arranged in an upper region of the chamber, so that, an ascending gas flow (draft) is produced in the chamber.

With such known devices, a flame or a plume can be moved, but apart from an irregular motion caused by the gas flow turbulence generated by a flame or smoke plume, or the draft of air in a room or in an exterior environment, there are no regular movements, and especially no functionality which rotates a flame or a plume of smoke.

The goal of the invention is to solve the problem of providing a device for light and/or smoke generation which imparts rotation to a flame or a plume of smoke, or which circulated heat to promote efficient heat convection, using the simplest possible means.

SUMMARY OF THE INVENTION

This problem is solved in the above-described device, by providing a gas inlet opening formed as a channel or a nozzle, wherein the gas inlet channel or gas inlet nozzle is designed so that gas flows through them into the chamber in the lower volume thereof, rotating about the heat source and then following a spiral path toward the gas outlet opening. Alternatively or in addition to the inventive solution, at least two, and preferably three or more gas inlet openings can be provided in the above-described device which are each configured to allow an inflowing gas to flow through them into the chamber into the lower chamber volume in a rotating flow around the heat source and to follow the same or analogous courses as gas entering from other such inlets. Both inventive solutions enable the rotating of a flame or a plume of smoke by passive means.

In a particularly advantageous embodiment of the inventive device, the gas inlet openings are each designed to direct inflowing gas through them into the chamber in a gas inflow direction, the direction vector of which has one component parallel to a tangent to an imaginary circle which corresponds with the directional sense of rotation, which extends inside the chamber in a plane level with the heat source and which rotates about this in a circle around the chamber's renter, and wherein the at least two gas inlet openings are preferably arranged at evenly spaced locations in the chamber wall along the imaginary circle surrounding the heat source. It is believed that the optimal sense of rotation of the gas in the chamber is dependent on whether the device is to be used in the northern or Southern hemisphere of the planet. Due to the jets of gas flowing into the chamber in the same rotational sense, each of which avoiding the heat source, a rotational movement of the gas inside the chamber is generated around the heat source. When the heat source is a flame, this rotational movement of the gas in the chamber moves around the flame to the flame, so that the flame is also rotated therewith. A typical plume of smoke rising above the heat source follows a helical, winding, upward path around a vertical axis to the upper gas outlet.

Preferably, the chamber is formed by a chamber housing, wherein the lower part of the chamber is formed as an enlarged portion and wherein the upper area of the chamber acts as a chimney to the enlarged portion. The enlarged portion accommodates the heat source and, if necessary, the smoke source, while the chimney-section produces, along with the directed, gas inlet openings in the base of the chamber, an ascent path of the gases in the chamber induced by the draft created by the heat source.

The gas inlet openings can be formed as gas inflow oriented channel sections or can be formed as nozzles. Thus the air current of an inlet gas through a gas inlet opening is forced along a flow direction following the direct line of communication, whether straight or curved, between the location of the respective gas inlet opening and the enlarged area of the chamber in which the heat source is located. Alternatively or additionally, concerning the gas inlet openings, the means of orientation of gas inflow may be located on the inside of the chamber wall. In a specific embodiment, these channel sections are formed as a straight channel extending from the outside to the inside wall of the chamber through the chamber wall, as a hole or bore through the chamber wall. Instead of a bore, the channels can be formed as any desired form, for example, rectangular cross sections. The channels or nozzles can be straight or curved. If they are curved, they are curved to begin to move the air passing therethrough in a circular motion about the heat source before actual entry of the directed gas into the chamber. The alignment of the channel sections is preferably such that the axis of the channel and the tangent of the wall in the area of the channel form an acute angle. This angle should lie in the range between approximately 5° to 45°. In this way, deceleration of the inlet gas by "wall friction" with the chamber inner walls can be minimized, and secondly, a sufficiently large torque can be exerted on the gas in the chamber, so that a sufficiently strong rotational movement of the chamber gases can be attained around the heat source.

Preferably, the chamber wall should have a base or enlarged portion of the chamber housing with a circular cross section in plan view. However, an elliptical, or regular polygonal cross section in plan view may also be suitable where the derogations from a circular form are not enough to disturb the rotation of air flow in the chamber. Also, the chamber wall of the chimney-section of the chamber housing should have a corresponding circular, or, possibly elliptical, or regular polygonal cross section in plan view along a horizontal plane at any height of the chimney-section. This chamber geometry in the lower and upper chamber area, particularly the circular cross section, minimally disturbs the rotational movement of the rising gases in the chamber. Particular preference is therefore an embodiment in which the base or enlarged section of the chamber and the chimney sections are cylindrical, or rotationally molded about a common vertical axis of symmetry.

Particularly advantageous is when the chamber has at least three gas inlet openings. The distribution of total inlet gas on three or more gas inlet openings better ensures that at none of these openings is the inlet gas flow rate too high, thus avoiding unwanted turbulence. The laminar inflow of the gases thus generated by the gas inlet openings and the consequent laminar flow of the gas inside the chamber contribute to the stable, defined rotating flow of the gas in the chamber. Turbulent, non-stationary swirling of the gas will be so avoided, leading to a uniform rotational movement of a flame at the bottom of the chamber such that the rotating flame resembles a small banner or flag deflected from the horizontal axis, rotating on its vertical pole. When extinguished, a relatively un-smeared, i.e., well-defined plume of smoke is created which helically rises, visible at least in the bottom portion of the chamber.

Preferably, the gas inlet openings are distributed evenly and arranged at locations in the chamber wall which correspond to different, equally-spaced apart locations along the circumference of the imaginary circle surrounding the heat source. This spacing ensures a uniform, even circularly symmetrical flow of gases around the central vertical axis of the chamber, which promotes, through the already mentioned laminar inflow through the openings, a uniform, virtually steady flow of gas in the chamber.

Preferably, the chimney-section of the chamber housing is tapered inwardly from the bottom to the top, i.e., the horizontal cross section of the chimney of the chamber housing decreases with increasing height in the chamber. It is particularly advantageous when the chamber tapers inwardly in the fireplace area from bottom to top in a conical or hyperbolic manner. These features also inhibit turbulence in the ascending gas flow by better ensuring a smooth, uninhibited exit of gases which optimize the updraft. Note that a chimney portion having a slight bottle neck may be used but is not ideal because the escaping hot air will be hindered at the bottle neck, and so, it is more likely that unwanted turbulence will result.

The heat source can be formed by any means for generating a flame, such as in particular through a candle flame, an oil lamp flame, a gas flame or the like. In particular, alcohol as a liquid fuel can be used for the flame. Alternatively, the heat source can be formed by a resistive heating element which is particularly useful when the invention is used as a heater for a home. The inventive apparatus can be both a source of light or heat as well as include a smoke source, wherein the means for generating a plume of smoke and the smoke source can be a stick of incense, an incense cone, incense pyramid or incense hut, or the like. Such an embodiment should be used together with a centered flame, in order to generate enough draw to circulate air in the chamber.

There is utility in at least parts of the chamber wall being made of a transparent or translucent material, which preferably consists of the chimney-section of the chamber housing made of a heat resistant glass. The base or enlarged portion of the chamber housing may be made of metal, ceramic, polymer, stone, brick, concrete, or the like. Preferably, the chamber housing is formed of multiple components, with the base or enlarged portion of the chamber housing comprising a first portion, particularly of metal or a ceramic, and a second portion, the existing chimney-portion of the chamber housing, consisting of glass, preferably heat resistant boron silicate glass (e.g., borosilicate float glass 3.3, or BG33). When used with a candle heat source, it is particularly advantageous when the chimney-part is sealingly seated on the base portion, in a removable manner. Thus, in this manner, the intake of "unwanted air" from undefined or unknown points of the apparatus can be avoided. In the multi-part version, the channels can be formed by slits in the upper wall edge of the base portion whose upper surfaces are sealed by a horizontal flange which extends from the edge of the chimney section, or are sealed by a separate portion. Such slots can e.g. are formed by sawing or milling and then closed in its otherwise open upper part to create a channel capable of directing gas inflow. Where the invention is used as a fireplace and chimney, such slots can be formed using bricklaying methods by bricks or by pouring concrete in an appropriate concrete mold.

The base or enlarged portion can have a form, in particular, a depression or recess, which receives the heat source. The depression can, for example, serve for receiving a candle in the form of a tea light candle. The depth of the recess is selected such that the candle flame is located at the level of the top surface of base portion, in order to ensure that the flame is visible during use. Preferably, the gas inlet openings are arranged in the chamber wall at the same level as the source of heat inside the chamber. This ensures that, at approximately the height of the heat source, the horizontal components of flow velocity are large, compared to the rising component of the flow, i.e. the vertical component of flow velocity. The flame is then induced to turn like a rotating flag around its flagpole, around its wick. Due to the constriction toward the gas outlet opening in the upper chamber area, the chimney-gases rise more rapidly in the upper region during their upward climb toward the gas outlet opening. During which time laminar flow conditions exist in the bottom of the chamber, turbulence can occur at the top of the chamber near the outlet opening. Turbulence is not completely eliminated. In the case of a rising plume of smoke, this means that just before their exit from the apparatus, the plume becomes intermingled, i.e. smeared. Nevertheless, over a considerable height of the chimney, the smoke plume can appear as an upwardly moving, winding lamellar thread.

To further enhance the inventive system, a vaporizable fragrance may be placed in the chamber. The heat provided by the heat source promotes the evaporation of scent. Furthermore, the fragrance is quickly delivered by the chimney to the environment. The aforementioned turbulent swirling near the gas outlet opening contributes to the rapid and uniform distribution of fragrance molecules in the environment.

To provide special lighting effects, e.g. projection of the light generated by the rotating flame to the walls of a room, reflective surfaces can be fitted to sections of the chamber inner wall. Alternatively, longitudinal sections comprising say 90 or 120 degrees of the circumference of the chimney portion, can be fitted with a reflective surface or treated so as to have reflective properties such as are mirrored surfaces on mirrors. In another embodiment, a lamp shade with decorative cutout patterns can be placed around the device. When the flame moves, such patterns are projected on the walls of the room. Of course, the chimney portion can be made of different colored glass or a mix of different colors which will provide a further unique visual effect when light from the flame is projected on the wall.

Usefully, the heat source and the source of smoke are co-located or very close to each other, or the smoke enters through a gas inlet (which, because of temperature differences and smoke condensation, must be carefully arranged). This helps pass the smoke immediately into a defined laminar flow so that a plume of smoke can be visible as it travels to the upper gas outlet.

Preferably, the heat source and/or the smoke source are located at the center of the lower area of the chamber. As already mentioned, where the rotating portion of the gas flow is relatively large compared with the rising proportion, there may even be the possibility of arranging multiple heat sources and/or smoke sources, all of which should, however, preferably be in the middle near the base of the chamber.

In a specific embodiment of the inventive system, the chamber can be height adjustable, so that the freight difference between the position of at least one gas inlet opening and the position of the gas outlet opening can be varied. This allows the updraft of the gas flow in the chamber, as well as the volume of gas in the chamber, to be adjustable.

In another specific embodiment, the entire device is constructed in one piece or all the parts forming the device are rigidly connected. Such one-piece device is preferably made of glass or a heat resistant, transparent polymer such as "PEEK". To produce such a device, one preferably uses a casting or injection molding process. This allows for the production, together with the gas inlet openings, to be formed in a single step. In such an embodiment, the candle or other heat source enters through an opening in the bottom of the single piece unit, to an appropriate position where the flame is approximately at the level of the gas inlet openings. In this case, it is advisable to place the candle on a ceramic or metal, or otherwise fire resistant saucer in order to protect the surface on which the candle is placed from heat or wax staining.

One can also provide further adjustability of the device by allowing the direction and/or the cross section of the inlet port forming the channels or nozzle to be adjustable. When using jets or channels which taper inwardly toward the outlet end on the chamber, the swirling turbulent gas flowing in the chamber can be taken into account to optimize the resulting air circulation.

BRIEF DESCRIPTION OF THE DRAWINGS

Further advantages, characteristics and applications of the invention emerge from the following, non-limiting description of an embodiment of the invention, wherein.

Those skilled in the art will appreciate that elements in the figures are illustrated for simplicity and clarity and have not necessarily been drawn to scale. For example, the dimensions of some of the elements in the figures may be exaggerated relative to other elements to help improve understanding of various embodiments of the present invention. Furthermore, the terms 'first', 'second', and the like herein, if any, are used inter alia for distinguishing between similar elements and not necessarily for describing a sequential or chronological order. Moreover, the terms 'front', 'back', 'top', 'bottom', 'over', 'under', and the like in the Description and/or in the Claims, if any, are generally employed for descriptive purposes and not necessarily for comprehensively describing exclusive relative position. Skilled artisans will therefore understand that any of the preceding terms so used may be interchanged under appropriate circumstances such that various embodiments of the invention described herein, for example, are capable of operation in other configurations and/or orientations than those explicitly illustrated or otherwise described.

DETAILED DESCRIPTION OF THE PREFERRED EMBODIMENT(S)

The following descriptions are of exemplary embodiments of the invention and the inventor's conception of the best mode and are not intended to limit the scope, applicability or Configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

Figure 1:
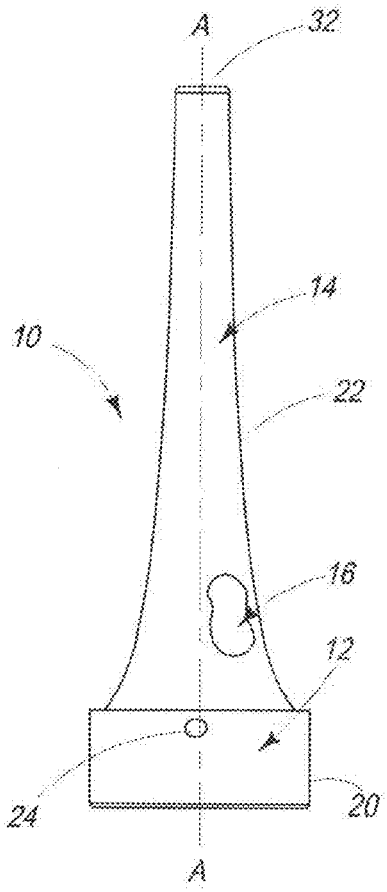
FIG. 1 shows a side view of the inventive system.

Referring to FIG. 1, a side view of the device 10 of the invention is shown. The chamber 16 is defined by a bottom portion 12, and an upper section 14. The lower section 12 of the chamber 16 is formed by a base portion 20, while the upper section 14 of the chamber 16 is formed as a chimney-section 22. In the lower base section 20, there are three gas inlet openings 24, 26, 30 (see FIG. 3) defining channels 40 that pass from the exterior to the interior of the base portion 20, into a recess 20 formed therein, one of which is shown in FIG. 1 (where gas inlet opening 24 is visible). The chamber 16 is preferably rotationally symmetric about the axis A-A. The gas outlet opening 32 is formed at the upper end of the upper chimney section 22.

Figure 2:
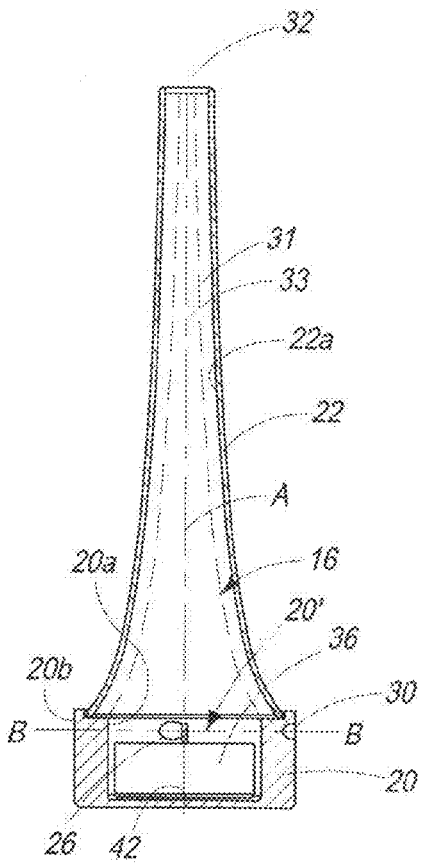
FIG. 2 shows a sectional view of the apparatus of FIG. 1 along a vertical plane through the axis A-A of FIG. 1.

Referring to FIG. 2, sectional view of the apparatus of FIG. 1 is shown taken along a vertical cutting plane passing through the axis. A-A of FIG. 1. All the elements of FIG. 2 which correspond with the elements of FIG. 1 bear the same reference numerals as in FIG. 1. The same is true with all figures. In this section, the view formed by the chamber portions 20 and 22 is shown. The base section 20 surrounds the lower portion 12 of the chamber 16. In this lower area inside the recess 20' of the base section 20, a candle 36 is disposed. The candle 36 is in the form of a tea light candle, having standard dimensions known in the art, and including an aluminum or tin outer shell into which wax is poured. The depth of the lower region 12 of the chamber 16 corresponds to the height of the wax body 36*b* of a new tea light. In this embodiment, the wick 36*a* of a new tea light candle is located approximately at the same height as the three-gas inlet openings 24, 26, 30 in the base portion 20. These three gas inlet openings 24, 26, 30 define a plane B-B which extends perpendicular to the axis A-A. In FIG. 2, only the gas inlet openings 26 to 30 are at least partially visible. The chamber inner wall in the lower section 12 of the chamber 16 bears the reference numeral 20*a*. The chamber inner wall in the upper part 14 of chamber 16 bears the reference numeral 22*a*.

Dashed lines 31 bound, in exemplary fashion, an area 33 where the chimney 22 may preferably be mirrored. The effect of such mirroring is that one can better see multiple reflections 35 of the rotating flame 280 on the mirrored surface 33—(visible even without a mirrored surface 33 in FIG. 7).

Figure 3:
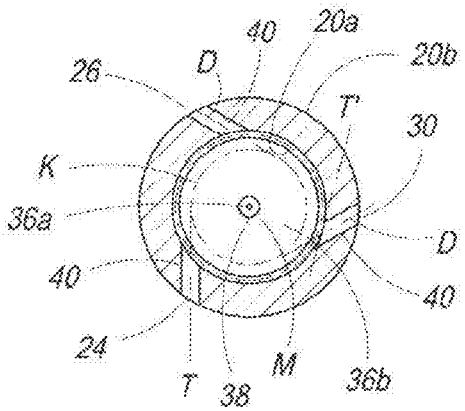
FIG. 3 is a sectional view of the apparatus of FIG. 1 taken along the horizontal axis BB of FIG. 2, a horizontal cutting plane.

FIG. 3 shows a sectional view of the apparatus of FIG. 1 along the cutting plane B-B of FIG. 2. The three gas inlet openings 24, 26, 30 are each formed as a channel 40. The wick 36*a* of the tealight is located in the center M of an imaginary circle K, which, for example, can be randomly concentric with the outer edge of the round tea light 36. Between the imaginary circle K and the inner wall 20*a* of the chamber wall 20 is a radial distance which corresponds roughly to a radius of an air inlet of a channel 40. Further, the radius of the chamber inner wall 20*a* is larger than the radius of the wax body 36*b* of tealight 36. The longitudinal axis D of the channel section 40 of each gas inlet opening 24, 26, 30 continues along a tangent. T to the imaginary circle K, and is essentially parallel to this imaginary circle, and, at the same time, the longitudinal axis of the channels D of each gas inlet opening 24, 26, 30 forms a sharp angle between 5° and 45° with a tangent plane of T' to the chamber inner wall 20*a*, when the angle measured is the angle which opens to the outside (away from the center) of the device 10.

Optionally, in order to better center the tea light candle 36, a magnet 38 is disposed in the center, on the floor of surface 42. A typical tealight candle 36 includes a small, centered ferromagnetic panel (usually of steel) to which the wick 36*a* is attached and is located at the bottom of the tea light, thereby providing a centered ferromagnetic object that the magnet can be attracted to, thereby helping center the tealight.

Figure 4:
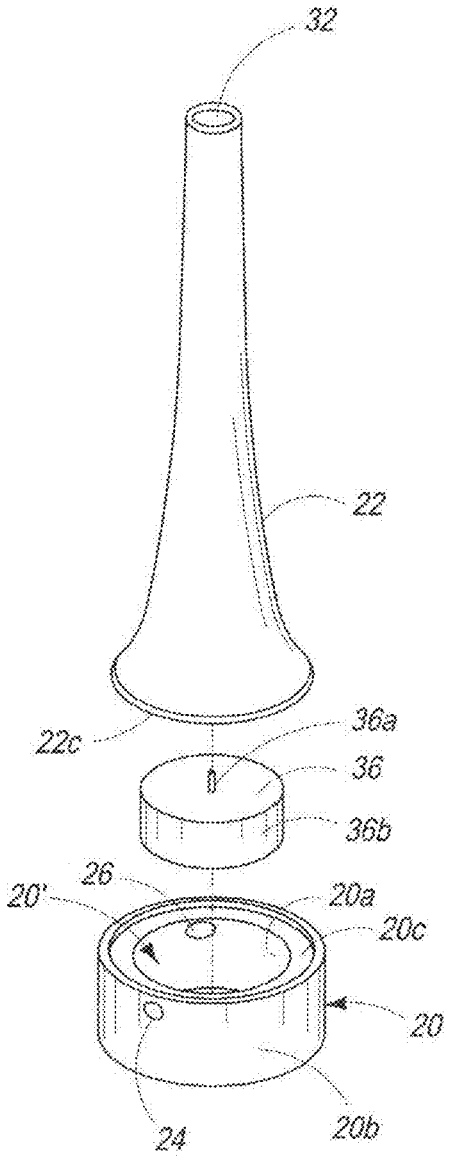
FIG. 4 is a perspective exploded view of the apparatus of FIG. 1 showing the respective components represented in an exploded condition along the axis A-A of FIG. 1.

FIG. 4 is a perspective exploded view of the apparatus of FIG. 1, the components of which are represented in perspective, exploded view, along the axis A-A of FIG. 1. The base section 20 and section of the chimney 22 are designed as separable parts. The lower edge 22*c* of the chimney section 22 fits into a complementary recess or shoulder 20*c* of the base section 20. If one places the chimney section 22 on the base section 20 into the shoulder 20*a*, one obtains, between the bottom edge 22*c* and the shoulder 20*c*, a sufficiently airtight connection to prevent the intrusion of too much unwanted air into the chamber 16. On the base section 20, the gas inlet openings 24, 26 extend through the wall of the base section 20 from the outside 20*b* to the inside 20*a*. The tealight 36 can be inserted into the socket or recess 20' of section 20, which is slightly larger than the wax body 36*b* of the tealight 36, thus facilitating insertion and removal of the tealight 36. Advantageously, the outer tin shell of the tealight 36 prevents wax from melting and becoming stuck in the recess, allowing for easy removal of an expended tealight and its replacement with a new tealight.

In order to place the device shown in FIGS. 1-4 in operation in a space of ambient temperature, one need only place a tealight 36 in the base recess 20' and light the wick 36*a* of the tealight 36. Then one places the chimney section 22 on the base-section 20, so that the lower edge 22*c* of the chimney section 22 and the shoulder 20*c* of the base abut against one another thereby sealing base portion 20 against chimney 22. Where a one piece embodiment 60 (shown in FIG. 6) is used, there is no need to place the lower edge 22*c* of the chimney section 22 on the shoulder 20*c*. Where a fireplace embodiment 90 (shown in FIG. 8A) is used, the chimney section 22' is fixed and need not be positioned, although the closures 92, 92' and 102 must be properly positioned for proper operation. By means of the flame 28 (e.g., shown in FIG. 7) of the tealight 36, the air in the chamber 16 is heated and expands. This creates a draft in the chamber 16, whereby air from the vicinity of the gas inlet openings 24, 26, 30 is sucked into and along the channels 40 into the chamber 16. The entering air enters through the channels 40, in particular, along the channel axis T into the chamber 16 and then around the center M of the chamber 14 along the wall 20*a*. The incoming air creates, on the one hand, a rotational movement of the air in the lower section 12 of the chamber 16 around the wick 36*a* or flame 28. Note that the channels 40 are not directed directly toward the wick 36*a*. The flame 28 heats and activates the air which ultimately flows out from the chamber 16 via the gas outlet opening 32. Due to the interaction of the incoming air which enters obliquely through the gas inlet openings 24, 26, 30 and its being heated, the flame 28 moves at the wick 36*a*.

With closed holes 24, 26, 30, and no chimney section 22, the flame extends, assuming no wind, along the vertical axis A-A (see FIG. 1). With open holes 24, 26, 30, and the chimney section 22 attached, the flame 28 will nevertheless be deflected from the vertical axis A-A and be rotated around this axis.

The rotation of the flame 28 is relatively slow. Depending on the size of the gas inlet openings 24, 26, 30, the height of the structure and size of the gas outlet opening 32, the time required for a full rotation of the flame may be about 0.2 s to about 1 s. With a length of each channel 40 being about 1 cm, a diameter of about 4 mm for a circular channel cross section (for a bored hole), a height of the chimney section 22 being about 15 cm, a diameter of the circular opening 32 being about 1.5 cm, and an ambient temperature (i.e., air inlet temperature) of about 25° C., the flame rotation of a tealight of the inventive system is about 1 s per revolution.

The rotation of the flame 28 takes place smoothly, but probably not at a completely constant flame rotation speed. Rather, it has been observed that, particularly, if the wick 36*a* is not in the center, the rotational motion can slow down once per every flame revolution, and even stop. This irregularity in or ceasing of the rotation is due to a flame source, the wick 30*a*, or the heat source being eccentric to the axis A-A, or, in part, due to a curvature of a centrally disposed wick itself. Note that the regular rotation of the flame 28 can, be used with mirror surfaces 33 and/or an iris, pattern on the chimney section 22 to create a "moving" illumination of a room. Which moves with a period identical with the speed of rotation of the flame 28.

The hyperbolic (shown) or conical (not shown) upwardly tapered chimney section 22 is preferably composed of a material transparent to visible light, preferably flame and heat resistant glass. The glass may be of different colors or even a mix of colors, to provide a different aesthetic effect.

As already mentioned, by the geometry of the device (basically the size and number of gas inlet openings 24, 26, 30, the height or the chamber volume of the device, the size of the gas outlet opening 32, the shape of the chimney section 22 and the size of the flame 28), the manner, especially the speed, of the flame's turning, can be influenced.

Astonishing is the fact that, in the inventive system, the flame 28 is both driving element and the driven element. This is because the flame 28 produces the necessary energy for the movement of air which induces its, own movement (i.e., the movement of the flame-forming luminous particles in the rising air). By means of the inventive system, the flame is driven into continuous rotation.

There are several means for generating both a flame 28 and/or a plume of smoke in the chamber 16, and the device can benefit form different placements of the means for producing a flame and/or a plume of smoke in the chamber along an eccentrically arranged common vertical axis of symmetry A-A. Because of the circulating gas flow in the chamber 16, this results in many interesting smoke or flame patterns.

Figure 5A:
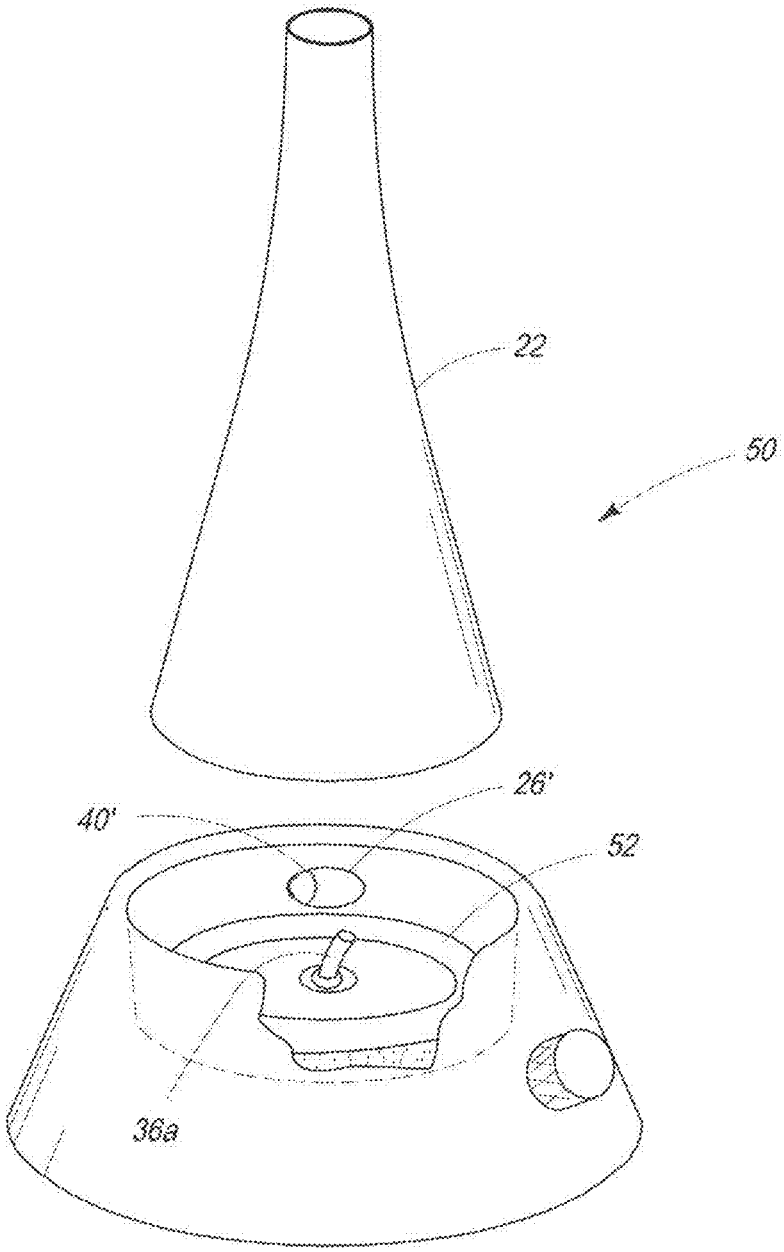
FIG. 5A is a perspective, partial breakaway view of an alternate embodiment of the invention using a liquid or gas fuel and having a depression for containing fragrant oil.
Figure 5B:
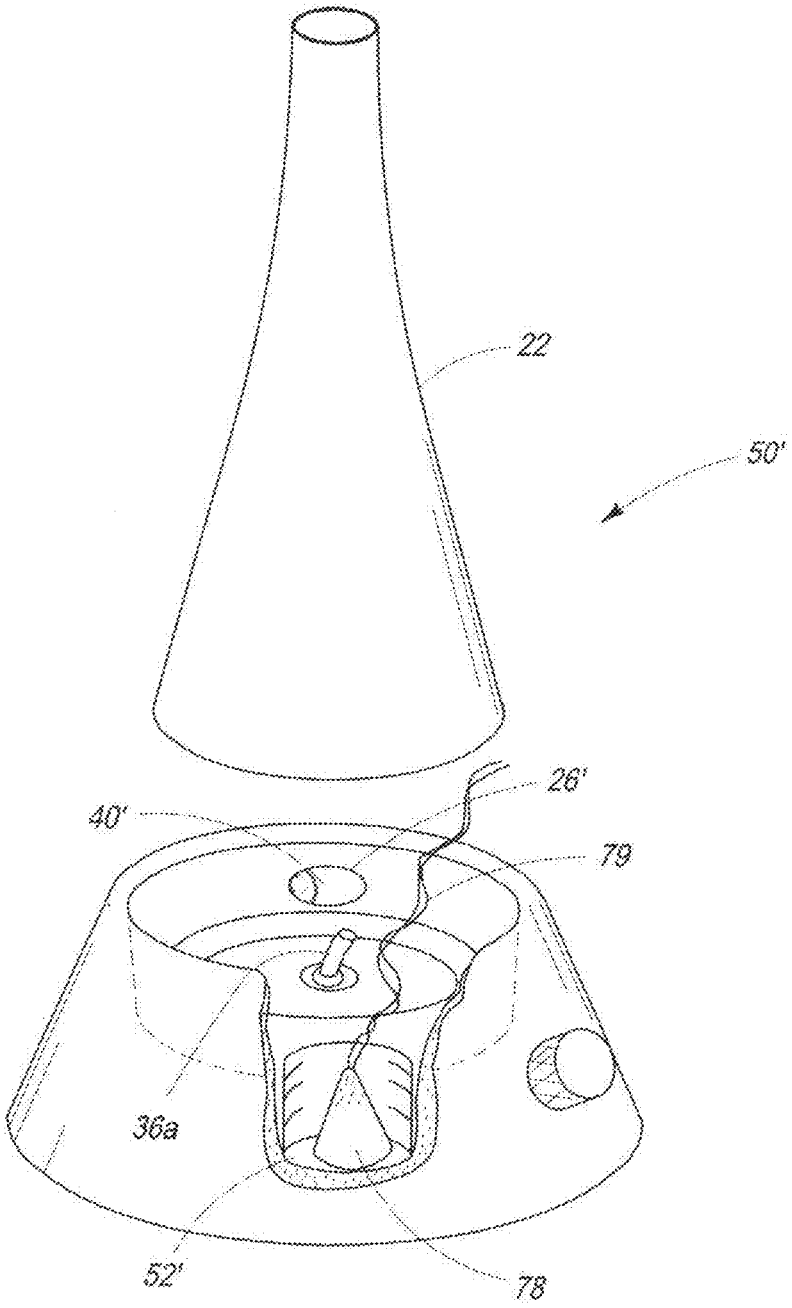
FIG. 5B is a perspective, partial breakaway view of an alternate embodiment of the invention having an internal compartment for burning incense.

FIG. 5A is a perspective view of an alternate embodiment 50 of the invention using a liquid or gas fuel and having a depression 52, in this case, an annular depression centered on the wick 36*a*, capable of Containing a fragrant oil. Instead of the candle flame 28 (which is a flame whose lower and upper portions do not move downwardly as the fuel is consumed, as in the case with a typical wax candle), a flame fueled by a liquid or gas has the advantage of being vertically stationary, thereby providing for consistent circular movement of the flame over the entire time that the flame is lit. Note as well that a buoyant candle (not shown) may be used which floats in a liquid such as water, which is provided in the cavity 20' in which the candle is placed. Alternatively, magnets (not shown) having sides which face each other, such sides having the same polarization, can be used to create a magnetic levitation of the candle, helping to keep the flame at the same level during the burning of the candle. A small compression spring (not shown) can help maintain the level of the flame of the candle, because as the candle burns, although the flame burns downwardly, the candle becomes lighter and so the spring helps move the candle upward as the flame burns downward, an effect which helps cancel out the tendency for the flame 28 to descend as the wax burns. A selection of the correct spring constant for the weight of the candle therefore, is all that is needed to help maintain the flame level. In FIG. 5B, another variant 50' is shown having an internal compartment 52' for receiving incense 78, whose smoke 79 rises and mixes with the swirling gases in the chamber 16, when the device is placed in operation.

Figure 6:
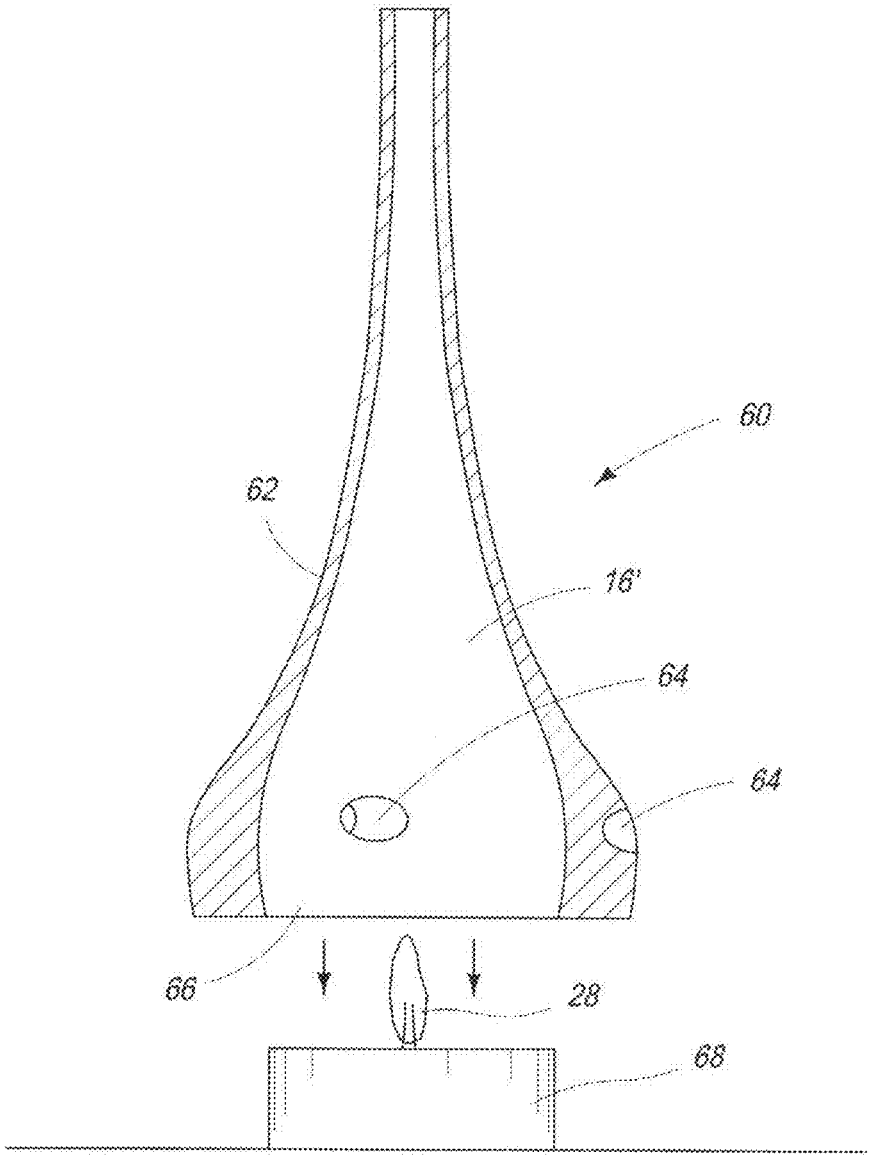
FIG. 6 is a cross sectional view of a second alternate embodiment of the invention, made in a single piece.

FIG. 6 is a cross sectional view of a second alternate embodiment 60 of the invention, made in a single piece, preferably by glass injection molding. An advantage of this embodiment 60 is its simplicity in that it is composed essentially of a single chimney portion 62 in which holes 64 (corresponding to holes 24, 26 and 30) are formed. The lower portion 66 is open and so the device can be placed over a burning candle 68. In addition, using this embodiment, one can adjust the central position of the candle very easily, to ensure that the flame remains at the center of the chamber 16', simply by displacing the device, until the desired flame motion is obtained.

Figure 7:
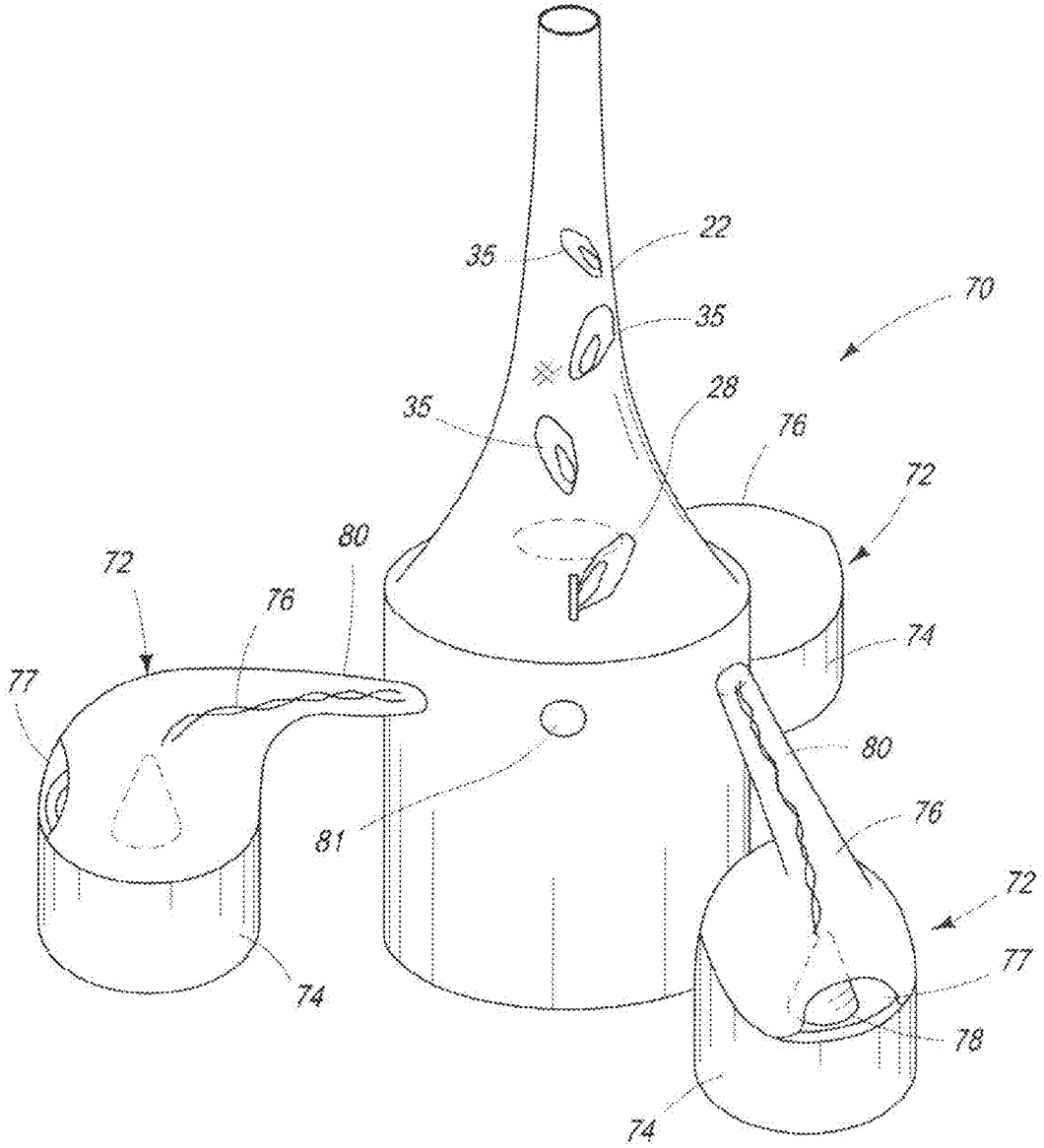
FIG. 7 is a perspective view of a third alternate embodiment of the invention, used to distribute smoke and fragrance from incense.

FIG. 7 is a perspective view of a third alternate embodiment 70 of the invention, used to distribute smoke and/or fragrance from a plurality of satallitic incense burners 72. These incense burners 72 include a base portion 74 and a transparent cover portion 76 allowing an air inlet opening 77. The base portion 74 receives and contains the burning incense 78. The cover portion 76 directs the smoke and/or aroma of the incense through tube portions 80 which enter into the gas inlet openings 24, 26 and 30, thereby feeding the smoke or aroma into the chamber 22 where it is mixed by the revolving gases and then disbursed in the air through the gas outlet opening 32. Note that the height of the base portion 20 is increased in this embodiment to allow the tube portions 80 to enter at the level of the flame 28 (i.e., to allow for the height of the incense burners 72). Further, where additional oxygen is needed in such an arrangement, additional gas inlet opening/channels 81 can be provided.

Figure 8A:
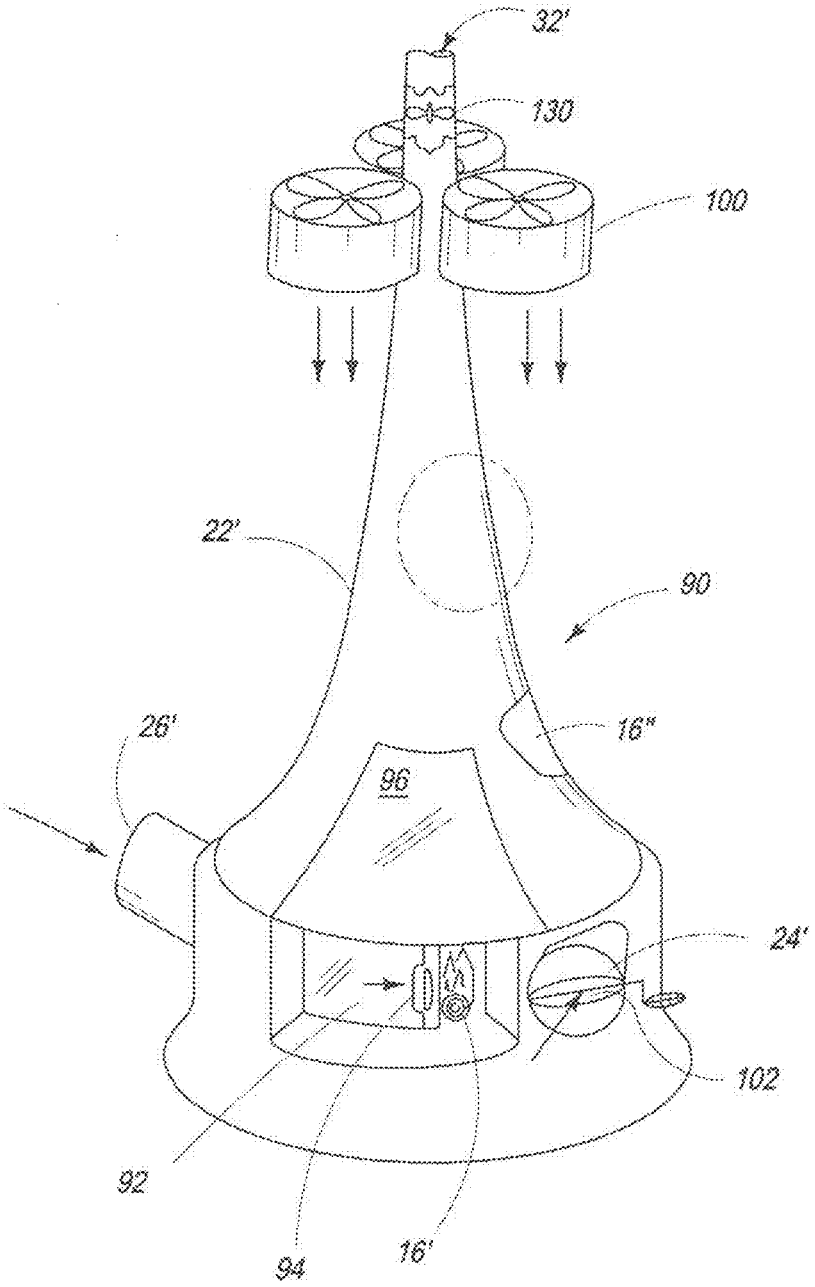
FIG. 8A is a perspective view of a fourth alternate embodiment of the invention, used as a fireplace for a home.
Figure 8B:
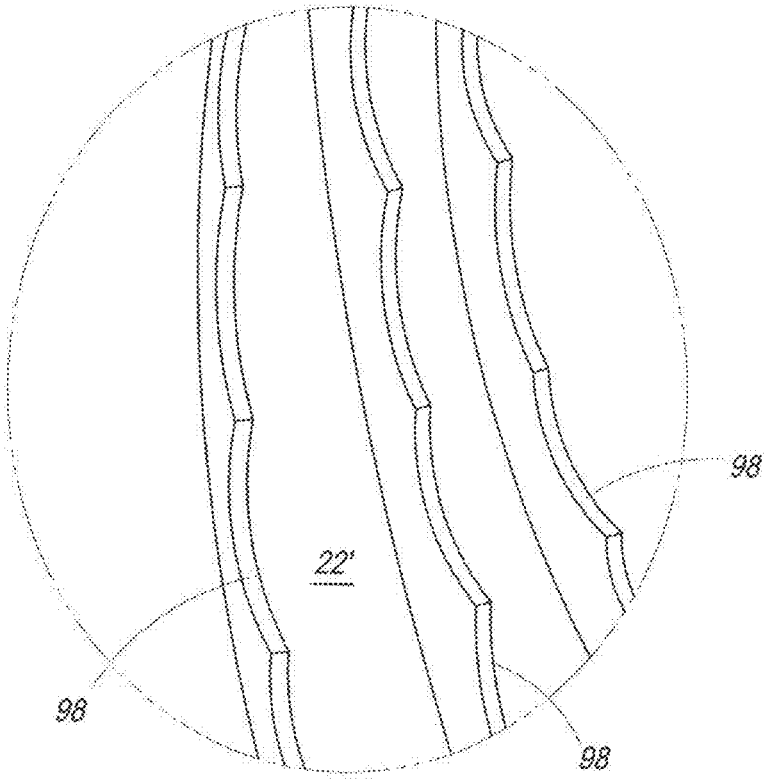
FIG. 8B is a close, up view of a portion of the embodiment shown in FIG. 8A.

FIG. 8A is a perspective view of a fourth alternate embodiment 90 of the invention, used as a fireplace of a home. In this embodiment 90, the most substantial differences with the embodiment for use as a fireplace 90 and the candle holder 10 is that (1) a transparent, sealable door 92, 92' preferably having a handle 94, allows for convenient opening for inserting wood for burning or for providing access for cleaning, and for closing the door, which seals the chamber 16' and (2) that the upper gas outlet 32' is connected to a stove pipe or other chimney for evacuation of hot gases, and (3) that a substantial portion of the chimney 22 is formed of a conductive, heat-radiating material such a copper, bronze, steel, iron or aluminum. For aesthetic reasons, a transparent portion 96 of the chimney 22' is provided, allowing for users to view the moving flames inside the fireplace 90. Further differences include the fact that it is advantageous to include vertical ribs 98 (shown in close up in FIG. 8B) and, perhaps fans 100 which blow ambient air over, the exterior portions of the chimney 22' toward the floor, thereby heating the air and recirculating such warmed air in the room while better protecting the user from the danger of touch of the heated chimney 22'. Further, dampers 102 may be provided in each gas inlet 24', 26' and 30', for adjusting the amount of air flow into the chamber 16'. To optimize heating, a computer controlled system may control the position of the dampers 102, the speed of the fans 130, and even the angle of entry of the gas inlet ducts 24', 26' and 30' (for example, using an arrangement shown in FIG. 9). Optionally, fans can be included in the ducts 24', 26' and 30' or in the stove pipe section 32' to be able to further control the convection of heat from the warm gases to the chimney 22' and then into the room. It can also be envisioned that the chimney 22' itself could include tubes carrying a fluid to which the heat is transferred and then pumped and distributed throughout the house, be it to water (i.e., thereby using the system as a water heater) or air (i.e., using the system to beat rooms in the house through ducts which transport the hot air directly to each room to be heated). Still further, a mechanism (not shown) can be provided which uses four bar linkages to raise fingers (preferably at least three) through slits in the floor of the fireplace, to lift and move the embers and burning wood to the center of the fireplace via a remote lever (not shown), in order to optimize the heating effect of the system of the invention.

Figure 9:
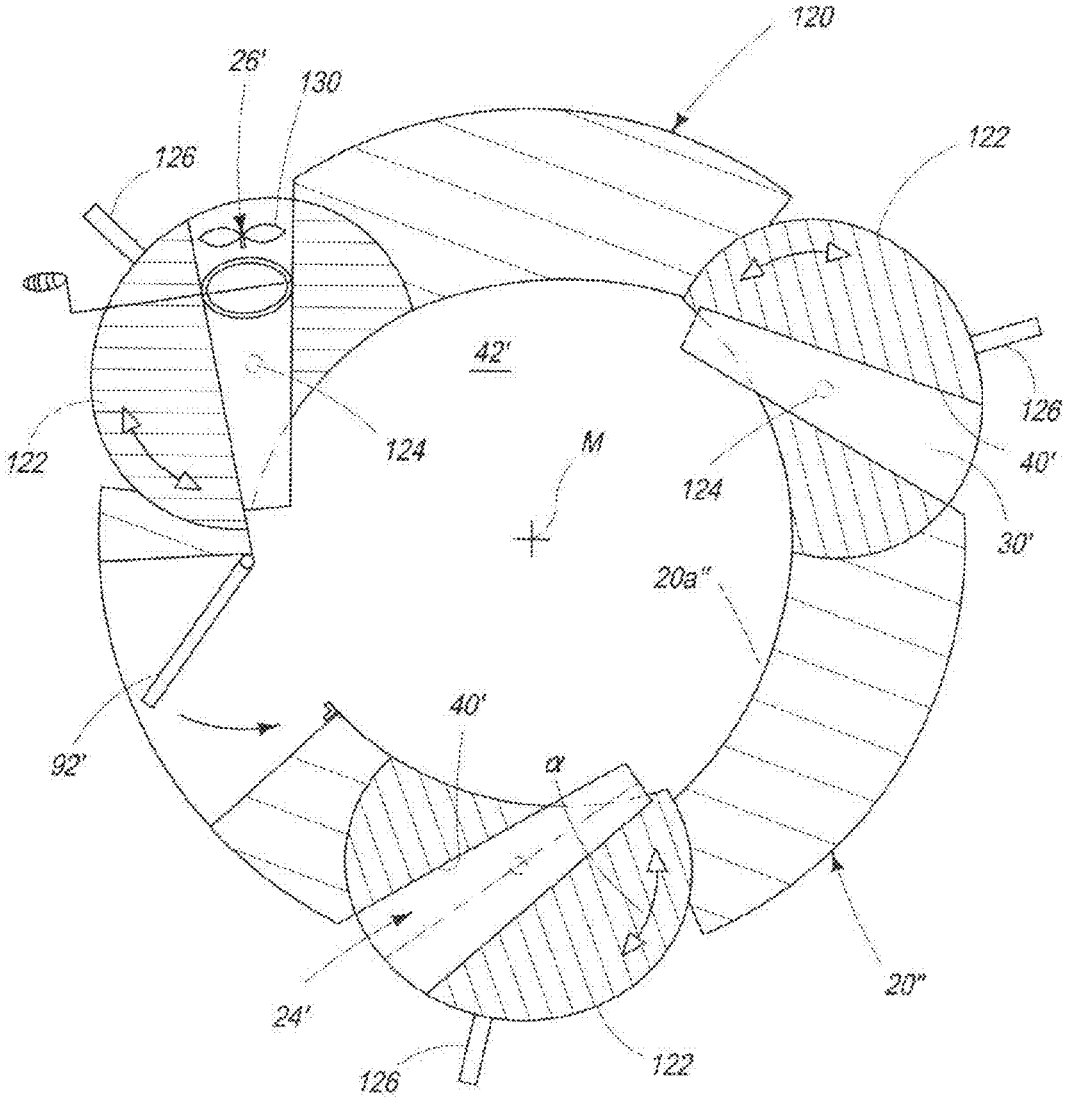
FIG. 9 is a top, sectional view of a fifth alternate embodiment in which the invention includes gas inlets whose direction is adjustable.

FIG. 9 is a top, sectional view of a fifth alternate embodiment 120 in which the invention includes gas inlets 24', 26', and 30' whose direction is adjustable via a housing 122 in which they are formed that pivots on an axis 124. In this embodiment, the angle $\alpha$ can be varied by, for example, moving the housing 122 via the handle 126. Alternatively, as mentioned above, the angle and position, as well as speed of fans 130 can be computer controlled, in order to optimize the heat convection and transfer in the system. Note that seals sealing between the housing 122 and the base portion 20" or around the door 92' which seal against unwanted air drafts are not shown, the design of which believed to be well within the capabilities of someone of ordinary skill in the art.

In an advantage, the invention provides a source of light and heat, or a visual stimulus which is desirable and unique.

In another advantage, the invention provides a "light spiel" which requires no batteries or other energy inputs other than the burning fuel of the heat source, which typically is a simple candle.

In another advantage, the fireplace embodiment of the invention provides a way to improve convective heat transfer to the chimney portion of the invention, thereby extracting more heat from the invention than prior art devices.

In another advantage, despite the almost direct contact of the glass portion 22 with the flame, the glass does not smudge up. Therefore, the flame itself provides the cleaning function of the chimney section.

it should be noted that the coriolis force effects the rotation of swirling gases in the chamber 16. However, the effect of this force is believed to be negligible, thereby allowing the invention to be designed either with a rightward or a left-handed rotation, with or against the coriolis acceleration forces. However, movement with the coriolis force would be preferred.

In the foregoing specification, the invention has been described with reference to specific exemplary embodiments; however, it will be appreciated that various Modifications and changes may be made without departing from the scope of the present invention as set forth in the claims below. The specification and figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above. For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, Other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components of any or all the claims.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted by those skilled in the art to specific environments, manufacturing specifications, design parameters or other operating requirements without departing from the general principles of the same.

The patents and articles mentioned above are hereby incorporated by reference herein, unless otherwise noted, to the extent that the same are not inconsistent with this disclosure.

Other characteristics and modes of execution of the invention are described in the appended claims.

Further, the invention should be considered as comprising all possible combinations of every feature described in the instant specification, appended claims, and/or drawing figures which may be considered new, inventive and industrially applicable.

Multiple variations and modifications are possible in the embodiments of the invention described here. Although certain illustrative embodiments of the invention have been shown and described here, a wide range of modifications, changes, and substitutions is contemplated in the foregoing disclosure. While the above description contains many specifics, these should not be construed as limitations on the scope of the invention, but rather as exemplifications of one or another preferred embodiment thereof. In some instances, some features of the present invention may be employed without a corresponding use of the other features. Accordingly, it is appropriate that the foregoing description be construed broadly and understood as being given by way of illustration and example only, the spirit and scope of the invention being limited only by the claims which ultimately issue in this application.

The invention claimed is:

1. Apparatus for rotating heated air in a chamber, the apparatus having a gas inlet opening and a gas outlet opening, wherein the gas inlet opening and a heat source are located in a lower area of the chamber and the gas outlet opening is located in an upper region of the chamber so that an ascending gas flow may be generated in the chamber, wherein the heat source is located in the center of the chamber and the chamber tapers inwardly in a hyperbolic manner from bottom to the top and there is at least one gas inlet channel or nozzle formed so that inflowing gas flows therethrough in a directed manner along a directional vector into the lower area of the chamber such that a substantial component of the direction vector projects along an inner wall of the chamber and follows an at least approximately circular path along the inner wall in a common rotational sense around the heat source and then is drawn upwardly by a draw of the upwardly flowing heated gases along an approximately spiral path thereby rotating rising heated air from the heat source which passes through the gas outlet opening.

2. The apparatus of claim 1, wherein at least two gas inlet openings direct the gases into the chamber.

3. The apparatus of claim 2, wherein the gas inlet openings are evenly spaced about a circumference of a lower region of the chamber.

4. The apparatus of claim 1, wherein preferably three gas inlet openings direct the gases into the chamber.

5. The apparatus of claim 1, wherein the gas openings are adjustable.

6. The apparatus of claim 5, wherein the gas openings include closures that permit the constriction of air flow therethrough.

7. The apparatus of claim 5, wherein the gas openings include fans which augment flow of air therethrough.

8. The apparatus of claim 5, wherein the direction of channels of the gas openings can be repositioned to modify the air circulation characteristics in the chamber.

9. The apparatus of claim 1, wherein a cross section of the chimney section forms a circular, elliptical or polygonal form in plan view.

10. The apparatus of claim 1, wherein the chimney section is formed around a common vertical axis of symmetry (A-A).

11. The apparatus of claim 1, wherein the chamber tapers inwardly from bottom to the top in a conical or hyperbolic manner.

12. The apparatus of claim 1, wherein the heat source is a candle flame, an oil lamp flame, a gas flame, a wood fire, or a resistive heating element.

13. The apparatus of claim 1, wherein, in addition to a heat source, a smoke source provides smoke in the chamber.

14. The apparatus of claim 1, wherein at least portions of the chamber wall are made of a transparent or translucent material.

15. The apparatus of claim 1, wherein, the lower area of the chamber, includes a recess for holding a vaporizable fragrance, or incense.

16. The apparatus of claim 1, wherein parts of the chimney section of the chamber have reflective surfaces.

17. The apparatus of claim 1, wherein there are at least three gas inlet openings, each formed to target inflowing gas through them into the chamber in a gas flow-direction, the direction vector of gas inflow in each case having a component of which is parallel to a tangent to an imaginary circle, the direction vector running with a directional sense of rotation around the heat source inside the chamber along the wall, the at least three gas inlet openings being arranged evenly spaced about the circumference of the chamber.

18. The apparatus of claim 17, wherein a central axis of the channels and a tangent of the inner wall of the chamber in the region of the gas inlet openings form an acute angle.

19. A method for rotating heated air in a device of claim 1, includes the steps of:

a. igniting a heat source located in a central location in a lower portion of the chamber so that the heat source provides a maximum of heat at a central location;

b. if not already positioned, positioning the chimney portion over the central location in a sealing relationship with the lower portion; and c. placing any closures in an operational position so that air is allowed to be drawn into the chamber directed into the lower area of the chamber approximately along an inner wall of the chamber about an at least approximately circular path following along the inner wall in the same rotational sense around the heat source and then drawn upwardly by a draw of the upwardly flowing heated gases though the gas outlet opening.

20. A candle holder for rotating a candle flame in a chamber, the candle holder having a gas inlet opening and a gas outlet opening, wherein the gas inlet opening is located in a lower area of the chamber, the lower area being adapted for receiving a candle, and the gas outlet opening is located in an upper region of the chamber so that an ascending gas flow may be generated in the chamber, wherein the heat source is located in the center of the chamber and the chamber tapers inwardly in a hyperbolic manner from bottom to the top and there is at least one gas inlet channel or nozzle formed so that, when a candle burns in the lower area of the chamber, inflowing gas flows therethrough in a directed manner along a directional vector into the lower area of the chamber such that a substantial component of the direction vector projects along an inner wall of the chamber and follows an at least approximately circular path along the inner wall in a common rotational sense around the candle and then is drawn upwardly by a draw of the upwardly flowing heated gases along an approximately spiral path and then through the gas outlet opening.

21. The apparatus of claim 1, the heat source is a flame located in the center of the chamber which the apparatus causes to rotate about a central axis of the chamber.

* * * * *